US005154214A

United States Patent [19]

Hagerman

[11] Patent Number: 5,154,214

[45] Date of Patent: Oct. 13, 1992

[54] MORTISING JIG

[76] Inventor: Randolph S. Hagerman, 100 Halesite Dr., Sound Beach, N.Y. 11789

[21] Appl. No.: 698,844

[22] Filed: May 13, 1991

[51] Int. Cl.[5] ..... B27M 3/00

[52] U.S. Cl. ..... 144/27; 33/197; 144/84; 144/144.5 R; 408/108

[58] Field of Search ..... 408/103, 105, 108; 33/147; 144/27, 68, 75, 76, 79, 82, 84, 144 R, 144.5

[56] References Cited

U.S. PATENT DOCUMENTS

| | | | |
|---|---|---|---|
| 631,202 | 8/1899 | Dearborn . | |
| 969,897 | 9/1910 | New . | |
| 2,268,930 | 1/1942 | Edwards . | |
| 2,843,167 | 7/1958 | Rushton | 144/76 |
| 3,700,344 | 10/1972 | Crumbach | 144/27 |
| 4,031,931 | 6/1977 | Balcombe | 144/83 |
| 4,235,268 | 11/1980 | Savary | 144/27 |
| 4,445,277 | 5/1984 | Keefe | 3/197 |
| 4,479,523 | 10/1984 | Peterson et al. | 144/144.5 |
| 5,067,337 | 11/1991 | Offner | 144/27 |

*Primary Examiner*—W. Donald Bray
*Attorney, Agent, or Firm*—William M. Nugent

[57] ABSTRACT

A self-contained mortising jig is disclosed which enables adjustable positioning and sizing of a mortise and which enables the use of a router or other tool to form finish or shallow mortises for mounting hardware, such as flush bolts, hinges, strike plates, reinforcement plates, finish lock mortises in door edges and other hardware. The mortising jig can be quickly applied to and removed from a surface to be mortised, and the position of the jig can be quickly and accurately adjusted. The mortising jig also enables mortises to be made in the edge of a door which is either bevelled or not bevelled.

13 Claims, 6 Drawing Sheets

MORTISING JIG

BACKGROUND OF THE INVENTION

1. Field of the Invention

The present invention is related generally to jigs for the placement and guidance of mortising tools. More specifically, it is directed to a self-contained jig which enables adjustable positioning and sizing of a mortise and which enables use of a router to form finish or shallow mortises for mounting of hardware, such as flush bolts, hinges, strike plates, reinforcement plates, finish lock mortises in door edges, and other hardware which can be advantageously flush mounted.

2. Description of the Related Art

Mechanical devices of many types, such as hinges, reinforcement plates, and the like, often require a shallow mortise to be made in a surface so as to enable the device to be flush mounted in the surface. Typical of such devices are various lock assemblies which may require initial deep or rough boring of surfaces as well as shallow or finish mortising for parts of the lock assemblies.

Locks for doors are generally either tubular or cylindrical locks, both types requiring the boring of holes in the edge and face of the door and in the jamb of the door frame to receive the bolt and latch assemblies. Tools for making these rough bores are known in the art, as are tools designed to guide boring tools.

The rough bore tools do not, however, enable the placement of the lock assembly face plate or strike plate such that the plates are flush with the surface in which the plates are installed. Flush placement is desirable for correct and smooth operation of the door and lock. When boring tools known in the art are used to make the rough bore for a lock, the locksmith must then provide a shallow or finish mortise to achieve the flush mounting of the plates. This is almost invariably done by using a hammer and chisel to create the shallow mortise. This has always been difficult to do precisely and a mistake could ruin the entire door, preventing correct installation of the lock and operation of the door. Moreover, the correct preparation of a quality finish mortise is very tedious and time consuming and is the most visible criterion by which the craft of the locksmith or installer is judged.

Another difficulty encountered in the art results from the variety of materials used for doors and particularly for door edges. These materials include wood (of various hardnesses), vinyl, sheet metal, aluminum, compressed paper products and structural foam under a vinyl layer. With many such materials, the use of a hammer and chisel to create the finished mortise may be made more difficult or may even be precluded.

Yet another problem not solved by devices in the art is the need for the finish mortise to compensate for the bevel in some door edges. That is, some door edges are slanted from one door face to the other so that the width of the face of the door whose edge first contacts the door jamb when the door is closed is slightly less than the width of the opposite door face. This enables the door to close properly with a reduced margin between the door edge and the frame of the door. Creating a mortise for such a door edge that enables the face plate to be flush mounted is not possible using tools and techniques known in the art.

Although the precise placement of the rough bores for locks and other hardware is usually not very important, precision placement for finish mortising is extremely important. Moreover, different plates to be flush mounted may require different widths and lengths of finish mortises. Tools and techniques known in the art lack simple adjustable means for quickly, easily and precisely positioning a template for making the mortise, and the art also lacks a jig having means for quickly, easily and precisely adjusting the width and length of the finish mortise.

Mortising tools in the art typically use several removable blocks inserted between the tool body and the door faces to adjust the position of the tool. The need to handle and simultaneously place several blocks in different positions is extremely awkward and time consuming. Moreover, such tools do not enable position adjustment over a continuous range, but rather only in discrete, predetermined amounts. Another disadvantage of such tools is that the user is forced to carry a variety of sizes of the blocks to accommodate different size doors, adding to the inconvenience of using the tools.

Other mortising tools in the art employ several threaded turnscrews, usually at least one at each extremity on each side of the tool, to adjust the position of the tool on the door. Such tools are difficult to adjust and require several independent adjustments and, usually, readjustments, to ensure that each part of the mortising tool is the same distance from the door surface. An important disadvantage of such tools is that it is virtually impossible to set each and every turnscrew to match the setting of every other screw, and thus the quality and the appearance of the resulting mortise may suffer.

Related tools in the art accomplish a very limited provision for different mortise sizes, typically by requiring the use of a separate template part to be inserted in a standard size jig aperture. A different template part must be used for each different size mortise. The disadvantages of such systems include multiplicity of parts to be carried by the installer, excessive time consumption in the identification of the appropriate template part and in its installation into the jig aperture, lack of a continuous range of mortise sizes to enable custom mortising, and complexity of use. The inconvenience and expense of such systems is well known to practitioners of the art.

SUMMARY OF THE INVENTION

Accordingly, it is an object of the present invention to provide a jig for making shallow mortises which overcomes the deficiencies of tools and techniques in the art.

It is an object of the present invention to provide a shallow mortising jig for positioning a mortising tool, such as a router, which is simple in construction, inexpensive to make, easy to use, and which does not require the use of separate additional component parts in conjunction with the tool to adapt it to various applications.

It is another object of the present invention to provide a mortising jig having self-contained position adjusting means, such that no additional separate blocking devices or a multiplicity of screw-type adjusters and the like are required for adjusting the position of the jig or the size of the mortise.

It is yet another object of the present invention to provide a shallow mortising jig which enables quick, easy and precise adjustment of the horizontal and vertical positions of the mortise and of the width and length of the mortise.

An additional object of the present invention is to provide a shallow mortising jig which provides for a continuous, rather than discrete, range of settings for jig position and for mortise size.

It is a further object of the present invention to provide a shallow mortising jig for use on bevelled and non-bevelled doors and which compensates for the bevel of bevelled door edges, such that the jig automatically enables flush mounting of hardware on either type of door.

It is yet another object of the present invention to provide a shallow mortising jig which includes calibrating means for enabling the user to simply and accurately adjust the size and position of the mortise to be made.

In order to achieve these and other objectives, the present invention includes a mortising jig for mortising a door edge which includes jig support means for supporting jig components; jig positioning means for positioning the mortising jig in contact with the door edge and for maintaining the jig in contact with the door edge; guide means attached to the jig support means for maintaining the jig positioning means in sliding contact with the jig support means and for guiding the movement of the jig positioning means; position adjusting means attached to the jig support means and to the jig positioning means for adjusting the jig positioning means such that the position of the mortising jig in contact with the door edge is determinable by adjustment of the position adjusting means; and an aperture in the jig support means for enabling a mortising tool to contact the door edge that is to be mortised.

In a preferred embodiment, the mortising jig of the present invention includes a base plate with a contact face for contacting the door edge; an aperture in the base plate through which the mortising tool contacts the door edge; a first sliding plate in sliding contact with the contact face of the base plate; and a second sliding plate also in sliding contact with the contact face of the base plate, the first and second sliding plates being slidably moveable toward and away from the aperture.

The preferred embodiment further includes first guide means attached to the base plate for guiding the movement of the first sliding plate toward and away from the aperture and for maintaining the first sliding plate in sliding contact with the contact face of the base plate, and second guide means attached to the base plate for guiding the movement of the second sliding plate toward and away from the aperture and for maintaining the second sliding plate in sliding contact with the contact face of the base plate.

Grip means, such as a ridge or ledge, attached to the first sliding plate may be included for enabling retracting force to be applied to the first sliding plate, such that the first sliding plate moves away from the aperture. This provides a quick and easy method of opening the jig for placement on and removal from the door edge.

The preferred embodiment also includes biasing means for biasing the first sliding plate toward the aperture, the biasing means including a spring connected to the base plate and in contact with the first sliding plate, such that springing force is applied to the first sliding plate to bias the first sliding plate toward the aperture.

Preferably, the device includes a first pressure plate attached to the first sliding plate for gripping a first face of a door, the first face of the door being substantially perpendicular to the door edge. The first pressure plate includes a first pressure plate inner face disposed toward the aperture. A second pressure plate is attached to the second sliding plate for gripping a second face of a door, the second face of the door being substantially perpendicular to the door edge, the second pressure plate including a second pressure plate inner face disposed toward the aperture. Also, preferably, each of the first and second pressure plate inner faces includes at least one portion, the surface of which is perpendicular to the contact face of the base plate and at least one other portion, the surface of which is not perpendicular to the contact face of the base plate. This configuration enables the mortising jig to mortise a door edge which is perpendicular to the first face of said door or to the second face of the door, and to mortise a door edge which is not perpendicular to said first face of the door or to the second face of said door. Preferably, for protection of the door finish and for increasing positional stability, a resilient layer of material is disposed on at least one, and preferably both, of the first pressure plate inner face and the second pressure plate inner face.

The preferred embodiment also provides position adjusting means connected to the base plate and to the second sliding plate for adjusting the position of the second sliding plate. The position adjusting means preferably also includes calibration means for calibrating the amount of movement of the second sliding plate in sliding contact with the base plate, so that the position of the jig on the door can accurately and quickly be determined for desired placement of the mortise. The calibration means preferably includes a bracket attached to the base plate, the bracket including a threaded bracket aperture, a shaft extending through the threaded bracket aperture and having a first end disposed in moveable contact with the second pressure plate, the second end being connected to a position adjusting knob. The shaft includes at least one threaded portion, the threaded portion of the shaft and the threaded bracket aperture being in screwable contact and being of a predetermined thread pitch, such that the rotation of the position adjusting knob by a known amount causes the shaft to move a known amount, thereby causing the second pressure plate to move by a known amount.

DETAILED DESCRIPTION OF A PREFERRED EMBODIMENT

Figure 1:
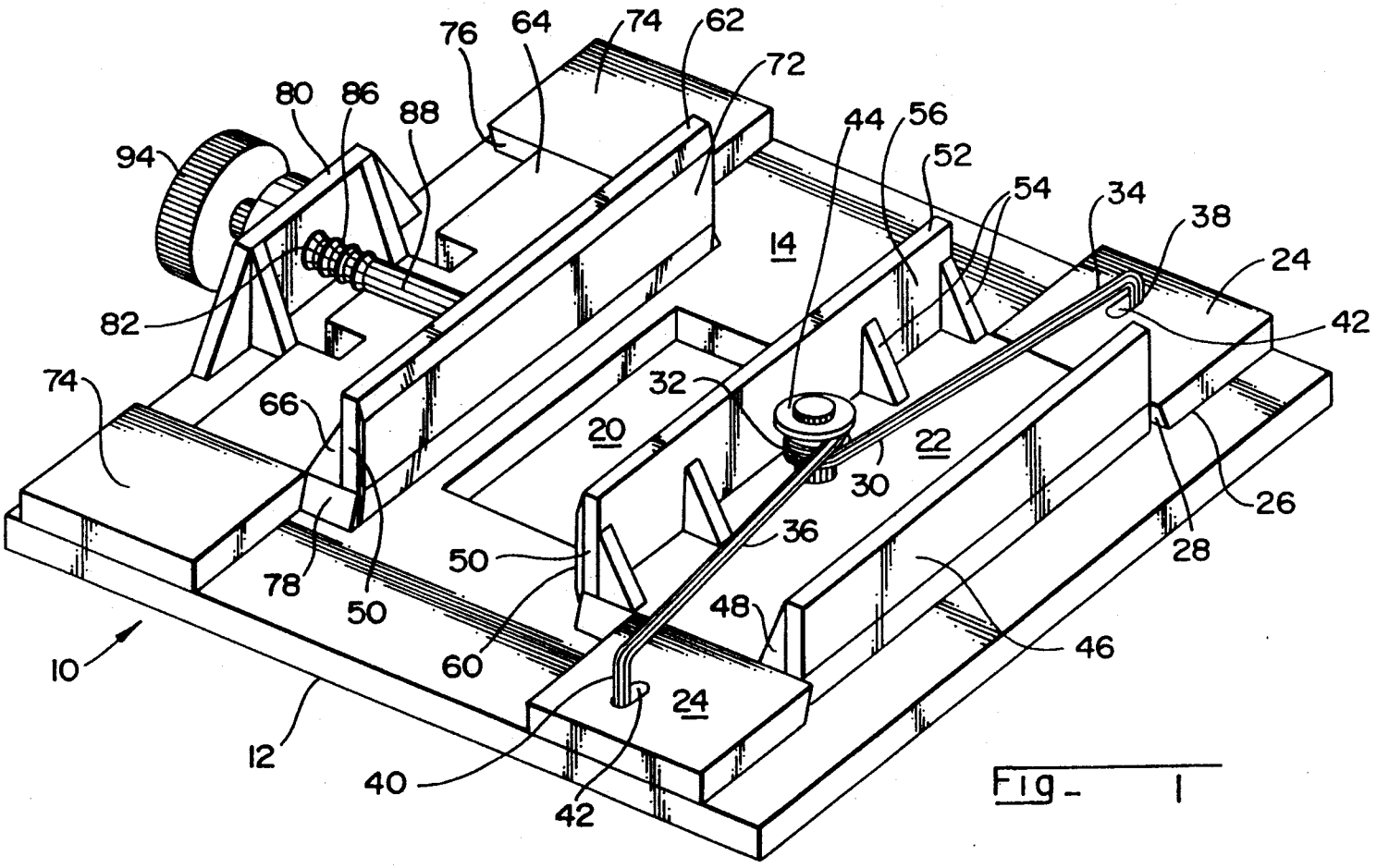
FIG. 1 is an overall perspective view of a preferred embodiment of the present invention.
Figure 2:
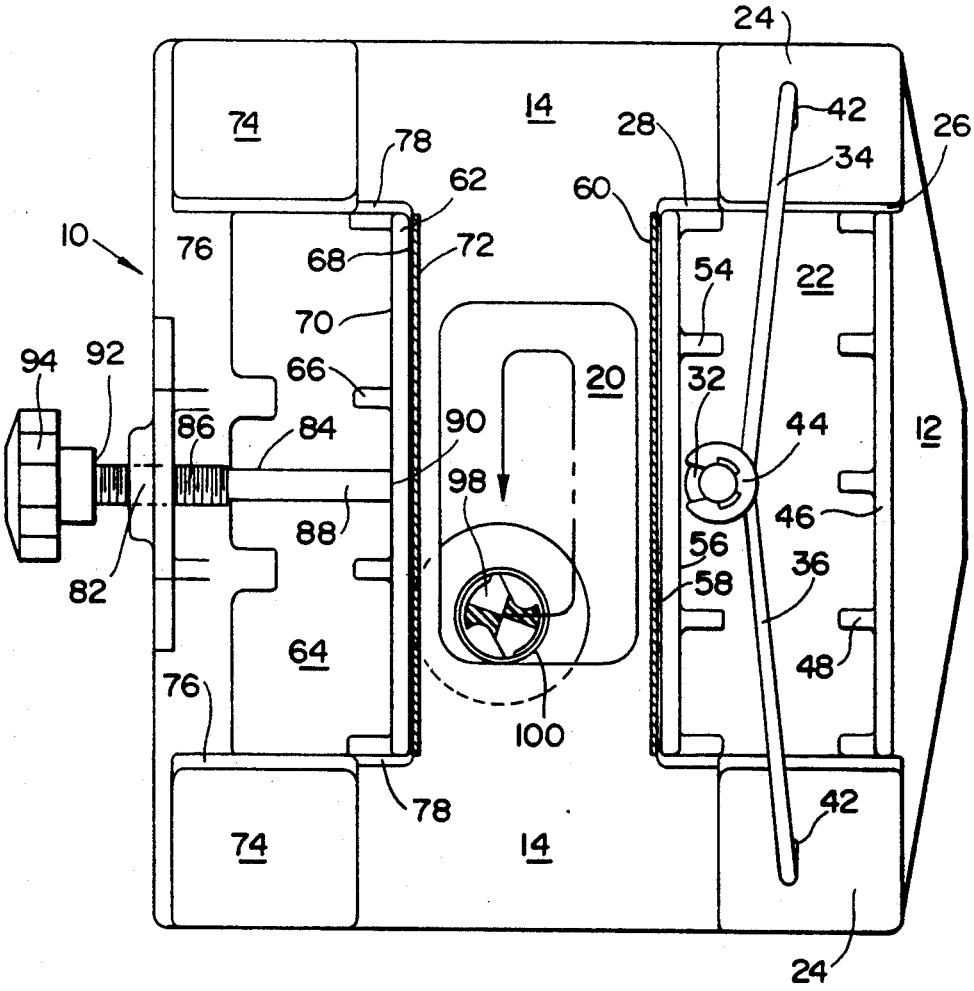
FIG. 2 is a top view of the embodiment shown in FIG. 1, showing the side of the mortising jig which is disposed in application toward a door edge.
Figure 3:
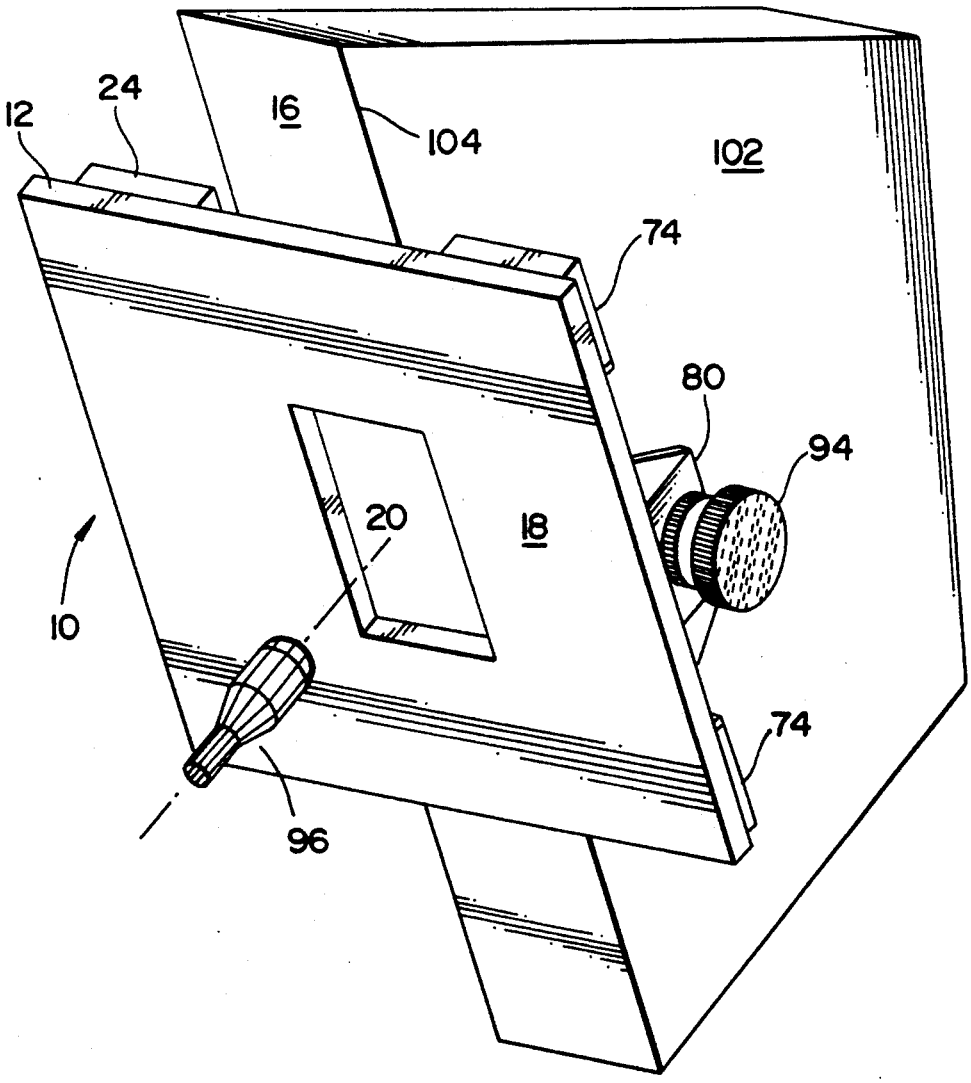
FIG. 3 is a perspective view of a preferred embodiment of the present invention showing it applied to a door edge.
Figure 4:
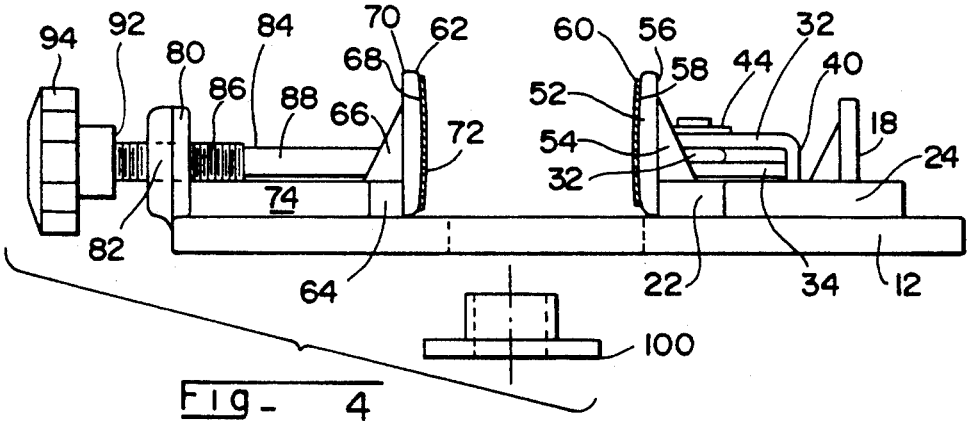
FIG. 4 is an end view of a preferred embodiment of the present invention showing door clasping means.
Figure 5:
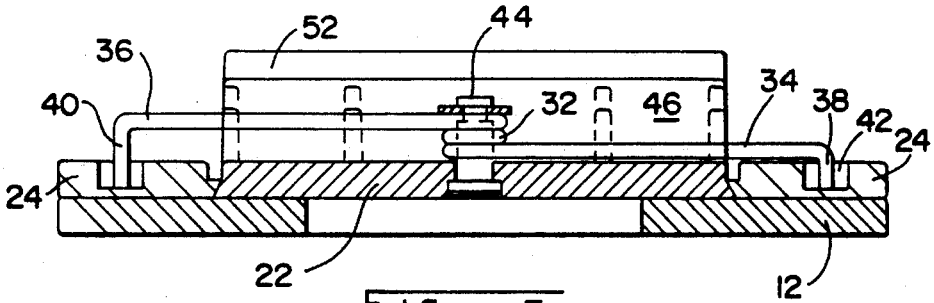
FIG. 5 is a sectional view of the preferred embodiment taken at Section Line A—A shown in FIG. 1 showing biasing means.
Figure 6:
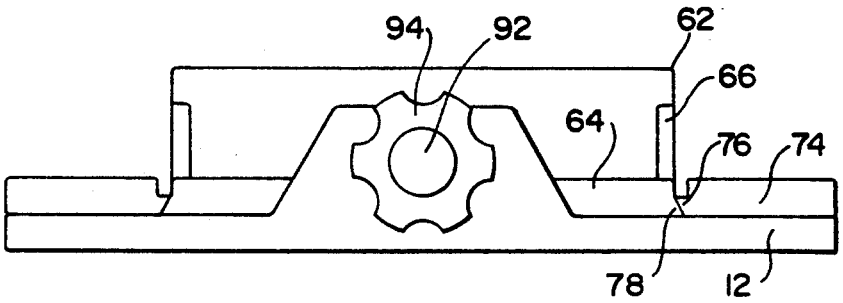
FIG. 6 is an end view of the preferred embodiment of the present invention showing position adjusting means.

A preferred embodiment of the present invention is shown in perspective view in FIG. 1, in a top view in FIG. 2, and in a view showing its application to a door in FIG. 3. The mortising jig, shown generally as 10, includes jig support means, which preferably includes a base plate 12 having a contact face 14 which is disposed toward a door edge 16, shown in FIG. 3, when jig 10 is in use, an outer face 18 disposed toward the user, and a base plate aperture 20 between contact face 14 and outer face 18. Base plate 12 may be constructed of any substantially rigid material, including metal, wood or plastics.

Mortising jig 10 also preferably includes first positioning means which preferably includes a first sliding plate 22 which is slidably disposed on contact face 14 of base plate 12 so as to be able to move toward and away from one side of base plate aperture 20. First sliding plate 22 preferably is slidably disposed between guide blocks 24, mounted on contact face 14, which maintain first sliding plate 22 in contact with contact face 14 while enabling first sliding plate 22 to move as indicated above. To accomplish this function, each of guide blocks 24 may advantageously include a dovetailed edge 26 disposed so as to oppose a reciprocal shaped dovetail edges 28 on first sliding plate 22.

The preferred embodiment shown in the figures includes biasing means for biasing the position of first sliding plate 22 toward aperture 20. The biasing means preferably includes a spring 30 having a central coil portion 32 for providing the biasing force, a first spring leg 34 and a second spring leg 36, each connected to central coil portion 32, first spring foot 38 connected at right angles to first spring leg 34, and second spring foot 40 formed at right angles to second spring leg 36.

First spring foot 38 and second spring foot 40 are each movably inserted into one of guide block spring foot apertures 42, so as to provide a support base for the biasing force of spring 30. Central coil portion 32 may be movably connected to first sliding plate 22 by means of spring anchor means 44. Spring anchor means 44 may be one of any attachment means which anchor spring 30 while allowing some relative movement between central coil portion 32 and spring anchor means 44. Typically, this may be a bolt or screw, or similar device.

Although a torsion-type spring is shown in the figures, it is understood by those skilled in the art that other biasing means, such as leaf or coil type springs and the like, can be used to obtain the same or similar effect.

Preferably, grip means 46 is attached to first sliding plate 22 in a manner such that the user of mortising jig 10 may exert manual pressure on first sliding plate 22 against the biasing force of spring 30, so as to allow first sliding plate 22 to be retracted away from aperture 20. Such motion allows quick and easy application and removal of mortising jig 10 from the surface on which it is to be used. Grip means 46 conveniently may be formed continuously with first sliding plate 22 or may be attached to first sliding means 22 in other conventional ways, preferably at a site distal to aperture 20, as shown. Grip means 46 may advantageously be supported by grip means supports 48 to increase structural strength.

Mortising jig 10 provides, in a preferred embodiment, door clasping means 50 for reversibly clasping a door and for mounting mortising jig 10 thereon. Preferably, one side of clasping means 50 includes first pressure plate 52, connected to first sliding plate 22, which is the means by which the biasing force of spring 30 is transmitted to one face of a door on which mortising jig 10 is mounted. First pressure plate 52 may be formed continuously with first sliding plate 22 or may be mounted in other conventional ways and may be supported additionally by first pressure plate supports 54 attached to first pressure plate 52 and to first sliding plate 22 to increase structural strength.

First pressure plate 52 preferably includes first pressure plate outer face 56 distal to aperture 20, first pressure plate inner face 58 proximate aperture 20, and first pressure plate resilient layer 60 attached, preferably by adhesion, to first pressure plate inner face 58 First pressure plate resilient layer 60 provides a cushion to protect the door surface from damage, as by scratching, by mortising jig 10, and provides friction to help maintain mortising jig 10 in position after it has been applied to a surface. As suggested in FIG. 1, resilient layer 60 preferably is used to increase the gripping force applied to a surface by first pressure plate 52.

Clasping means 50 preferably also includes, disposed on a side of aperture 20 opposite that of first pressure plate 52, second pressure plate 62. Second pressure plate 62 may be formed integrally with or may be attached to second sliding plate 64 which is a component of second positioning means for positioning mortising jig 10 on a work surface such as a door. Second pressure plate 62 may advantageously be supported by second pressure plate supports 66 which are attached thereto and to second sliding plate 64 so as to increase structural strength.

Second pressure plate 62 preferably includes second pressure plate inner face 68 proximate aperture 20, second pressure plate outer face 70 distal to aperture 20, and second pressure plate resilient layer 72 attached, preferably by adhesion, to second pressure plate inner face 68. Second pressure plate resilient layer 72 provides a cushion to protect the door surface from damage, as by scratching, by mortising jig 10, and provides friction to help maintain mortising jig 10 in position after it has been applied to a surface. As suggested in FIG. 1, resilient layer 72 preferably is used to increase the gripping force applied to a surface by second pressure plate 62.

Second sliding plate 64 preferably is slidably disposed between second sliding plate guide blocks 74 which are mounted on contact face 14, the guide blocks 74 maintaining second sliding plate 64 in contact with contact face 14 while enabling second sliding plate 22 to move as indicated above. To accomplish this function, each of guide blocks 74 may advantageously include a dovetailed edge 76 disposed so as to oppose an adjacent reciprocal shaped dovetail edge 78 on first sliding plate 64.

Second positioning means for positioning mortising jig 10 on a work surface such as a door also preferably includes adjusting means bracket 80 attached to contact surface 14 for adjusting the position of second sliding plate 64 and its attachments. Preferably, adjusting means bracket 80 includes an aperture 82 threaded on its inner surface to accept the insertion therethrough of position adjusting shaft 84. Position adjusting shaft 84 may be threaded for its entire length, although in the preferred embodiment position adjusting shaft 84 includes a threaded portion 86 which is sufficiently long to enable second sliding plate 64 to be moved thereby a desired distance to or away from aperture 14, and a non-threaded portion 88.

A first end 90 of position adjusting shaft 84 is disposed in movable contact with outer face 70 of second pressure plate 62 so as to transmit the driving force of second positioning means to second pressure plate 62 to cause the latter to move toward and away from aperture 20. A second end 92 of position adjusting shaft 84 is connected to position adjusting shaft knob 94.

Position adjusting shaft knob 94 is turned by the user of mortising jig 10, causing position adjusting shaft 84 to rotate. That rotation, by virtue of the interaction of the threaded inner surface of adjusting means bracket aperture 82 and threaded portion 86 of position adjusting shaft 84, causes position adjusting shaft 84 to move toward or away from aperture 20, depending on the direction of rotation of position adjusting shaft knob 94. That movement, in turn, transmits force from first end 90 of position adjusting shaft 84 to outer face 70 of second pressure plate 62, thereby causing second pressure plate 62 and second sliding plate 64 to move toward or away from aperture 20.

In a preferred embodiment of the present invention, threaded portion 86 of position adjusting shaft 84 and the threaded inner surface of adjusting means bracket aperture 82 have sixteen threads per inch. This is convenient and useful because one full turn of position adjusting shaft knob 94 causes a movement of position adjusting shaft 84, second sliding plate 62 and second pressure plate 62 one-sixteenth of an inch toward or away from aperture 20, depending on the direction position adjusting shaft knob 94 is turned. In a like manner, a one-quarter turn of knob 94 would enable precise adjustment of 1/64 inch. Such calibration makes it easy for the user to accurately adjust the lateral position of mortising jig 10 on a door in standard units of measurement rather than only in predetermined increments, without requiring actual physical measurement, marking and other preadjustment maneuvers as are necessary with related tools in the art. It is to be understood, of course, that the scope of the present invention includes calibrations in metric units which achieve equivalent functions and advantages as described in the preceding discussion in regard to non-metric units.

The structure of mortising jig 10 provides the user with a self-contained tool for making shallow mortises that is simple to use and does not require extraneous parts for operation. It also enables the user to make quick application of the device to surfaces and to make very accurate position and sized adjustments over a continuous range quickly and easily. The operation of mortising jig 10 can be explained with reference to the Figures in the context of installation of a faceplate for a mortise lock.

Normally, the rough drilling of a lock case cavity for insertion of the lock case into the door edge will be conducted first. The lock case may then be inserted into the lock case cavity and the dimensions of the faceplate traced. The lock case is then removed and mortising jig 10 applied to the door.

To apply jig 10, the user exerts pulling finger pressure to grip means 46 so as to retract first sliding plate 22, and therefore first pressure plate 52 away from aperture 20. This action provides sufficient space between first pressure plate 52 and second pressure plate 62 for insertion therebetween of door edge 16. Mortising jig 10 is applied to door edge 16 and its vertical position adjusted to the desired position.

Once door edge 16 is in the desired position in contact with contact face 14 of base plate 12, the pulling finger pressure applied by the user to grip means 46 is released, the biasing force of spring 30 causing first sliding plate 22, and therefore first pressure plate 52 to move toward aperture 20. This action causes the door to be gripped between first pressure plate 52 and second pressure plate 62, thereby maintaining mortising jig 10 in stationary contact with the door.

Next, viewing door edge 16 through aperture 20, the user determines the desired lateral position for the mortise to be made. The position may be centered laterally on door edge 16, or it may be offset from center in one direction or the other by any desired amount. To accomplish the correct placement of mortising jig 10 in the lateral direction, the user simply rotates position adjusting shaft knob 94, causing axial movement of position adjusting shaft 84 resulting from the interaction of the threaded inner surface of adjusting means bracket aperture 82. The axial movement of adjusting shaft 84 in turn causes second sliding plate 64, and therefore second pressure plate 62 to move toward or away from the door which is disposed between first pressure plate 52 and second pressure plate 62, depending on the direction in which position adjusting shaft knob 94 is turned.

Typically, a clockwise rotation of position adjusting shaft knob 94 will move second pressure plate 62 toward the door, although the reverse movement is possible if the threading configuration of threaded portion 86 of position adjusting shaft 84 and of the threaded inner surface of adjusting means bracket aperture 82 are reversed, as with left handed threading.

The movement of second pressure plate 62 toward the door exerts pressure through the door to first pressure plate 52, thereby causing first pressure plate 52, and therefore first sliding plate 22, to move away from aperture 20, while maintaining contact with the door surface. As a result, mortising jig 10 is caused to move in the opposite direction, thereby moving aperture 20 relative to door edge 16 in a direction toward adjusting means bracket 80. The opposite movement is accomplished simply by reversing the rotation of position adjusting shaft knob 94.

As pointed out above, the amount of lateral displacement of mortising jig 10 and aperture 20 relative to door edge 16 can be calibrated such that one full turn of position adjusting shaft knob 94 causes a lateral movement of one-sixteenth of an inch. Such a calibration is advantageous, but not necessary to achieve many of the benefits of mortising jig 10.

Once mortising jig 10 is set at the desired position, a router or other milling tool may be used to cut the finish mortise. The router includes bit 96, shown representatively in FIG. 3, which is inserted into aperture 20 of mortising jig 10 and moved around the circumference of aperture 20 to create the mortise in door edge 16. As indicated in FIG. 2, router bit 96 includes router bit blades 98 for cutting the material of door edge 16 and router cutting guide 100 for off-setting router bit blades 98 from the inner edges of aperture 20.

The width of aperture 20 from the side disposed proximate first pressure plate 52 and its side proximate to second pressure plate 62 may be $1\frac{1}{8}$ inches, although any other width, including those in metric units, are within the scope of this invention. With a width of $1\frac{1}{8}$ inch, the differential between the outer diameter of router bit blades 98 and the outer diameter of router cutting guide 100 may be one-eighth inch. When this differential is maintained, router 96 will cut a one inch wide mortise.

Mortising jig 10 enables the user to cut a wider mortise if desired simply by adjusting the lateral position of mortising jig 10 relative to door edge 16. For example, after placing mortising jig 10 on the door as described above and centering aperture 20 on door edge 16, the user may turn position adjusting shaft knob 94 one full turn clockwise, thereby moving aperture 20 one-sixteenth of an inch in one direction, then cut a finish mortise with router 96. Then, the user may turn position adjusting shaft knob 94 two full turns counter-clockwise so as to move aperture 20 in the opposite direction, past the centerline of door edge 16 to a position one-sixteenth of an inch beyond that centerline. Another mortise cut is then made with router 96. The result is a mortise of a width one-eighth inch wider than a mortise that would have been made absent the lateral repositioning of mortising jig 10.

Of course, position adjusting shaft knob 94 may be turned any desired amount, the turning not being limited to full turns only. And the finish mortise may be offset from the centerline of door edge 16 by simple adjustment of position adjusting shaft knob 94. Mortising jig 10 therefore provides the user with means for making mortises of virtually any size, without the need to use multiple, elaborate screw adjustments or blocking materials.

After the desired finish mortise is made, mortising jig 10 may be removed quickly and easily by the user's application of finger pressure to grip means 46 so as to retract first sliding plate 22, and therefore first pressure plate 52 from contact with the door in which the mortise was made.

An important aspect of a preferred embodiment of the present invention is that mortising jig 10 enables the user to make finish mortises in doors having bevelled edges as well as non-bevelled edges. In doors constructed with bevelled edges, the surface of door edge 16 is not perpendicular to door face 102, shown in FIG. 3, or its opposite door face, not shown. That is, door edge 16 is slanted so that, for example, the width of door face 102 from its hinge side to its jamb, or lock, side is less than the corresponding width of the opposing door face. Usually this is done so that the corner 104 between door face 102 of reduced width and door edge 16, is the first corner of door edge 16 to approach the door frame or jamb (not shown) when closing. This enables the door to have a narrow margin (relative to the frame) without contact occurring between the leading door edge and the frame upon closing. Thus, the door may be closed (or opened) without sticking.

Such bevelled edge doors create a problem for mortising in that, to produce flush mounting of the lock face plate, one side of the finish mortise should be shallower than the other side to accommodate the angle of door edge 16 in relation to door face 102. Mortising tools in the art have been unable to provide such finish mortises.

Mortising jig 10 according to a preferred embodiment of the present invention provides means for enabling the cutting of a finish mortise whose plane is not perpendicular to door face 102. This function is obtained by the configuration of door clasping means 50, as shown in detail in FIG. 7.

Figure 7:
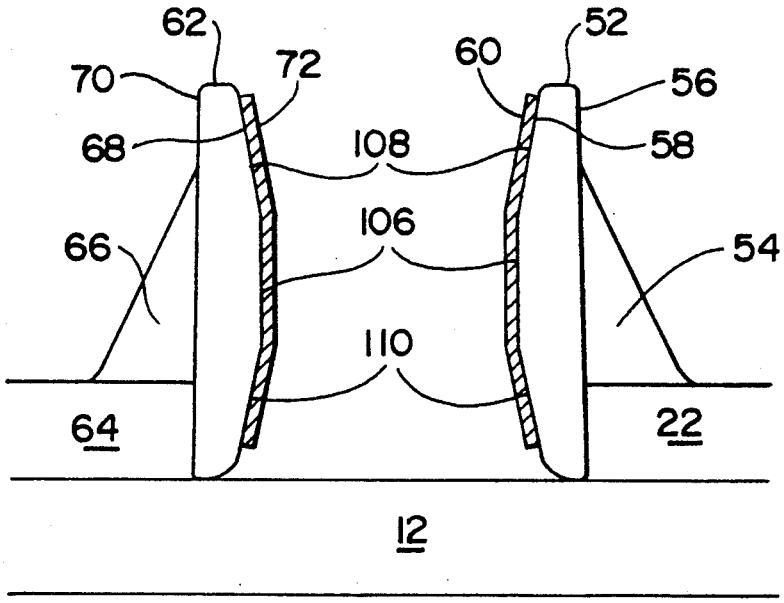
FIG. 7 is an enlarged side view of one embodiment of door clasping means of a preferred embodiment of the present invention.

In one embodiment, inner face 58 of first pressure plate 52 and inner face 68 of second pressure plate 62 each comprise a central portion 106, an upper portion 108 and a lower portion 110. The plane of each central portion 106 is perpendicular to the plane of contact face 14 of base plate 12. The planes of upper portions 108 are angled from central portions 106 away from each other, as shown in FIG. 7. In a like manner, the planes of lower portions 110 are angled from central portions 106 away from each other, also as shown in FIG. 7. The angle of the planes of upper portions 108 and lower portions 110 in relation to the planes of central portions 106 preferably is $3\frac{1}{2}$ degrees, but any appropriate angle may be used within the scope of the present invention. Resilient layers 60 and 72 are applied, preferably adhesively, to inner surface 58 and inner surface 68, respectively.

Figure 8:
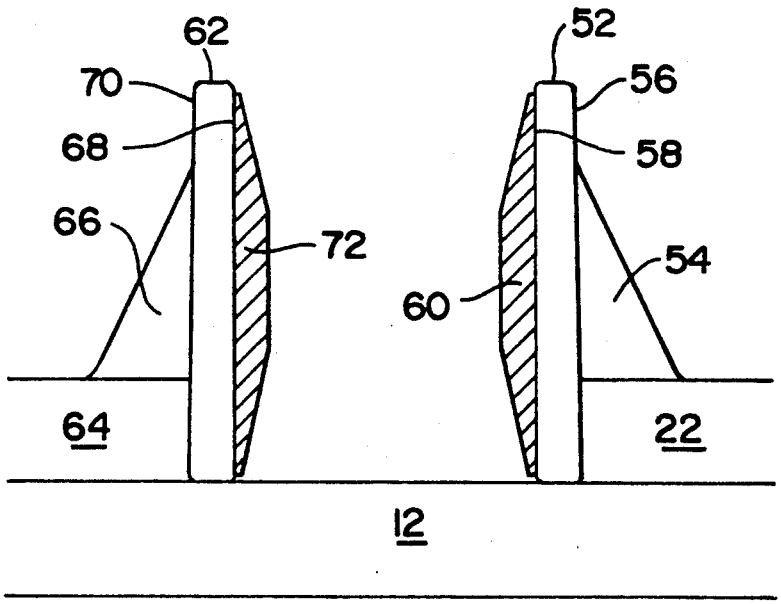
FIG. 8 is an enlarged side view of an alternative embodiment of door clasping means of a preferred embodiment of the present invention.

In an alternative embodiment of clasping means 50, shown in FIG. 8, the planes of inner face 58 of first pressure plate 52 and inner face 68 of second pressure plate 62 are perpendicular to the plane of contact face 14 of base plate 12. Resilient layer 60 and resilient layer 72, however, are formed so as to create desired angles as in the other embodiment.

Figure 9A:
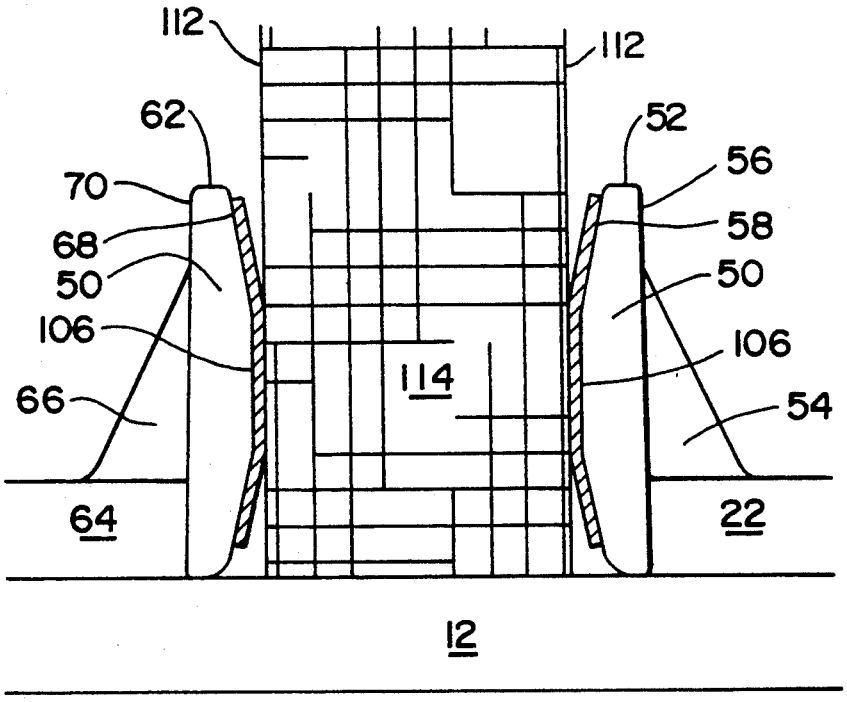
FIG. 9A is an enlarged view showing application of door clasping means of the present invention to a non-bevelled edge door.
Figure 9B:
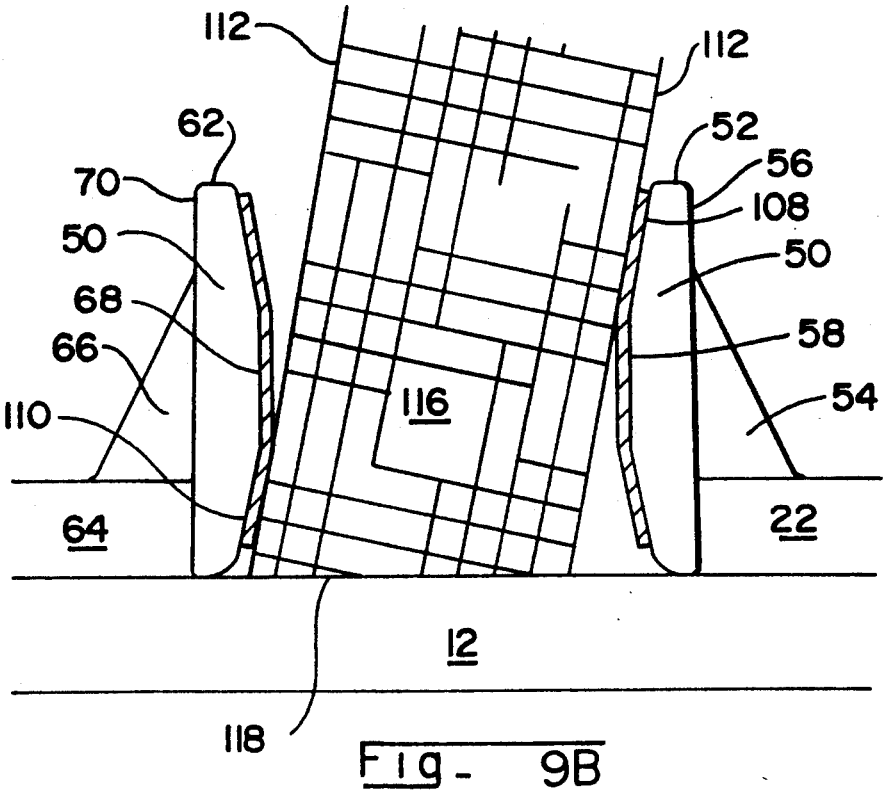
FIG. 9B is an enlarged view showing application of door clasping means of the present invention to a bevelled edge door.

FIGS. 9A and 9B show door clasping means 50 applied to a non-bevelled edge door and to a bevelled edge door, respectively. As indicated in FIG. 9A, central portions 106 of inner face 58 of first pressure plate 52 and of inner face 68 of second pressure plate 62 are in contact with faces 112 when mortising jig 10 is applied to non-bevelled edge door 114. As indicated in FIG. 9B, upper portion 108 of inner face 58 of first pressure plate 52 and lower portion 110 of inner face 68 of second pressure plate 62 are in contact with faces 112 when mortising jig is applied to a bevelled edge door 116. This configuration enables the user of mortising jig 10 to make a mortise in door edge 118, shown in FIG. 9B, that is shallower at one side of the mortise and deeper at the other side of the mortise, so as to provide flush mounting of the faceplate of the lock to be installed.

In the case of a bevelled edge door whose bevel is opposite that shown in FIG. 9B, the same principle of application of mortising jig 10 is used, but lower portion 110 of inner face 58 of first pressure plate 52 and upper portion 108 of inner face 68 of second pressure plate 62 are in contact with faces 112 when mortising jig 10 is applied to door 114.

Thus, the present invention overcomes many deficiencies in related devices in the art while at the same time accomplishing its objectives using a simplified, self-contained mortising jig structure. Not only does the present invention provide means for accomplishing its objectives, but it reduces the inconvenience and amount of work required of the user compared to devices known in the art. Although particular embodiments of the present invention have been shown and described herein, it will be obvious to those skilled in the art that various modifications may be made within the scope and spirit of the present invention. The scope of the invention is to be determined with reference to the appended claims, including equivalents of the elements therein.

I claim:

1. A mortising jig for mortising a door edge comprising:

jig support means for supporting jig components;

jig positioning means for positioning said mortising jig in contact with said door edge and for maintaining said mortising jig in contact with said door edge;

guide means attached to said jig support means for maintaining said jig positioning means in sliding contact with said jig support means and for guiding the movement of said jig positioning means;

position adjusting means attached to said jig support means and to said jig positioning means for adjusting said jig positioning means such that the position of said mortising jig in contact with said door edge is determinable by adjustment of said position adjusting means; and an aperture in said jig support means for enabling a mortising tool to contact said door edge through said aperture.

2. The mortising jig of claim 1 wherein said jig positioning means includes:

a first sliding plate disposed in sliding contact with said contact face of said base plate, said first sliding plate being slidably moveable toward and away from said aperture;

first guide means attached to said base plate for guiding the movement of said first sliding plate toward and away from said aperture and for maintaining said first sliding plate in sliding contact with said contact face of said base plate;

a second sliding plate disposed in sliding contact with said contact face of said base plate, said second sliding plate being slidably moveable toward and away from said aperture;

second guide means attached to said base plate for guiding the movement of said second sliding plate toward and away from said aperture and for maintaining said second sliding plate in sliding contact with said contact face of said base plate;

biasing means for biasing said first sliding plate toward said aperture; and a first pressure plate attached to said first sliding plate for gripping a first face of a door, said first face of said door being substantially perpendicular to said door edge.

a second pressure plate attached to said second sliding plate for gripping a second face of a door, said second face of said door being substantially perpendicular to said door edge

3. The mortising jig of claim 2 wherein said position adjusting means includes a bracket attached to said base plate, said bracket including a threaded bracket aperture therethrough, a shaft extending through said threaded bracket aperture and having a first end and a second end, said first end being disposed in moveable contact with said second pressure plate, said second end being connected to a position adjusting knob, said shaft including at least one threaded portion, said threaded portion of said shaft and said threaded bracket aperture being in screwable contact, such that the rotation of said position adjusting knob causes said shaft to move, thereby causing said second pressure plate to move in relation to said aperture.

4. The mortising jig of claim 2, further including calibration means for calibrating the amount of movement relative to said aperture of said second sliding plate in sliding contact with said base plate.

5. A mortising jig for mortising a door edge, comprising:

a base plate for supporting jig components, said base plate having a contact face for contacting said door edge;

an aperture in said base plate for enabling a mortising tool to mortise said door edge through said aperture;

a first sliding plate disposed in sliding contact with said contact face of said base plate, said first sliding plate being slidably moveable toward and away from said aperture;

first guide means attached to said base plate for guiding the movement of said first sliding plate toward and away from said aperture and for maintaining said first sliding plate in sliding contact with said contact face of said base plate;

a second sliding plate disposed in sliding contact with said contact face of said base plate, said second sliding plate being slidably moveable toward and away from said aperture;

second guide means attached to said base plate for guiding the movement of said second sliding plate toward and away from said aperture and for maintaining said second sliding plate in sliding contact with said contact face of said base plate;

biasing means for biasing said first sliding plate toward said aperture;

a first pressure plate attached to said first sliding plate for gripping a first face of a door, said first face of said door being substantially perpendicular to said door edge;

a second pressure plate attached to said second sliding plate for gripping a second face of a door, said second face of said door being substantially perpendicular to said door edge; and position adjusting means connected to said base plate and to said second sliding plate for adjusting the position of said second sliding plate.

6. The mortising jig of claim 5 wherein said position adjusting means further includes calibration means for calibrating the amount of movement relative to said aperture of said second sliding plate in sliding contact with said base plate.

7. The mortising jig of claim 6 wherein said calibration means includes a bracket attached to said base plate, said bracket including a threaded bracket aperture therethrough, a shaft extending through said threaded bracket aperture and having a first end and a second end, said first end being disposed in moveable contact with said second pressure plate, said second end being connected to a position adjusting knob, said shaft including at least one threaded portion, said threaded portion of said shaft and said threaded bracket aperture being in screwable contact and being of a predetermined thread pitch, such that the rotation of said position adjusting knob by a known amount causes said shaft to move a known amount, thereby causing said second pressure plate to move by a known amount.

8. The mortising jig of claim 5 wherein said biasing means includes a spring connected to said base plate and in contact with said first sliding plate, such that springing force is applied to said first sliding plate to bias said first sliding plate toward said aperture.

9. The mortising jig of claim 5, wherein said first pressure plate includes a first pressure plate inner face disposed toward said aperture, said first pressure plate inner face including at least one portion the surface of which is perpendicular to said contact face of said base plate and at least one other portion the surface of which is not perpendicular to said contact face of said base plate, and wherein said second pressure plate includes a second pressure plate inner face disposed toward said aperture, said second pressure plate inner face including at least one portion the surface of which is perpendicular to said contact face of said base plate and at least one other portion the surface of which is not perpendicular to said contact face of said base plate, such that said mortising jig enables the mortising of a door edge which is perpendicular to said first face of said door or to said second face of said door and enables the mortising of a door edge which is not perpendicular to said first face or to said second face of said door.

10. The mortising jig of claim 9 wherein at least one of said first pressure plate inner face and said second pressure plate inner face includes a resilient layer of material.

11. The mortising jig of claim 1, further including grip means attached to said first sliding plate for enabling retracting force to be applied to said first sliding plate such that said first sliding plate moves away from said aperture.

12. The mortising jig of claim 5, further including grip means attached to said first sliding plate for enabling retracting force to be applied to said first sliding plate such that said first sliding plate moves away from said aperture.

13. A mortising jig for mortising a door edge, comprising:

a base plate for supporting jig components, said base plate having a contact face for contacting said door edge;

an aperture in said base plate for enabling a mortising tool to mortise said door edge through said aperture;

a first sliding plate disposed in sliding contact with said contact face of said base plate, said first sliding plate being slidably moveable toward and away from said aperture;

first guide means attached to said base plate for guiding the movement of said first sliding plate toward and away from said aperture and for maintaining said first sliding plate in sliding contact with said contact face of said base plate;

a second sliding plate disposed in sliding contact with said contact face of said base plate, said second sliding plate being slidably moveable toward and away from said aperture;

second guide means attached to said base plate for guiding the movement of said second sliding plate toward and away from said aperture and for maintaining said second sliding plate in sliding contact with said contact face of said base plate;

biasing means for biasing said first sliding plate toward said aperture, said biasing means including a spring connected to said base plate and in contact with said first sliding plate, such that springing force is applied to said first sliding plate to bias said first sliding plate toward said aperture;

a first pressure plate attached to said first sliding plate for gripping a first face of a door, said first face of said door being substantially perpendicular to said door edge said first pressure plate including a first pressure plate inner face disposed toward said aperture;

a second pressure plate attached to said second sliding plate for gripping a second face of a door, said second face of said door being substantially perpendicular to said door edge, said second pressure plate including a second pressure plate inner face disposed toward said aperture;

wherein said first pressure plate inner face includes at least one portion the surface of which is perpendicular to said contact face of said base plate and at least one other portion the surface of which is not perpendicular to said contact face of said base plate, and wherein said second pressure plate inner face includes at least one portion the surface of which is perpendicular to said contact face of said base plate, such that said mortising jig enables the mortising of a door edge which is perpendicular to said first face of said door or to said second face of said door, and at least one other portion the surface of which is not perpendicular to said contact face of said base plate, such that said mortising jig enables the mortising of a door edge which is not perpendicular to said first face of said door or to said second face of said door;

a resilient layer of material disposed on at least one of said first pressure plate inner face and said second pressure plate inner face;

position adjusting means connected to said base plate and to said second sliding plate for adjusting the position of said second sliding plate, said position adjusting means including calibration means for calibrating the amount of movement of said second sliding plate in sliding contact with said base plate, wherein said calibration means includes a bracket attached to said base plate, said bracket including a threaded bracket aperture therethrough, a shaft extending through said threaded bracket aperture and having a first end and a second end, said first end being disposed in moveable contact with said second pressure plate, said second end being connected to a position adjusting knob, said shaft including at least one threaded portion, said threaded portion of said shaft and said threaded bracket aperture being in screwable contact and being of a predetermined thread pitch, such that the rotation of said position adjusting knob by a known amount causes said shaft to move a known amount, thereby causing said second pressure plate to move by a known amount; and grip means attached to said first sliding plate for enabling retracting force to be applied to said first sliding plate such that said first sliding plate moves away from said aperture.

* * * * *